United States Patent [19]

Kurmis

[11] Patent Number: 5,050,649

[45] Date of Patent: Sep. 24, 1991

[54] STRAP AND TOOL FOR LOOPING AND CLAMPING AROUND ELONGATE ARTICLES

[75] Inventor: Viktor Kurmis, Pinneberg, Fed. Rep. of Germany

[73] Assignee: Paul Hellermann GmbH, Pinneberg, Fed. Rep. of Germany

[21] Appl. No.: 613,247

[22] Filed: Nov. 14, 1990

[30] Foreign Application Priority Data

Nov. 15, 1989 [DE] Fed. Rep. of Germany ..... 8913514
May 2, 1990 [DE] Fed. Rep. of Germany ..... 9004993

[51] Int. Cl.[5] ..... B21F 09/02
[52] U.S. Cl. ..... 140/93 A; 140/93.2
[58] Field of Search ..... 140/93 A, 93.2, 123.5, 140/123.6; 24/16 PB

[56] References Cited

U.S. PATENT DOCUMENTS 3,976,108 8/1976 Caveney et al. .
4,640,320 2/1987 Avison et al. .

FOREIGN PATENT DOCUMENTS 0264142 4/1988 European Pat. Off. .
1296476 6/1966 Fed. Rep. of Germany .
390434 10/1990 Fed. Rep. of Germany .

*Primary Examiner*—Lowell A. Larson

*Attorney, Agent, or Firm*—Chilton, Alix & Van Kirk

[57] ABSTRACT

A strap (2) consisting of a strap tongue (3) and a strap lock (4) which has an orifice (7) for receiving the strap tongue (3) is looped and clamped around an elongate article by means of a tool. The tool possesses a looping guide (12, 13, 14) closable around the article and intended for the strap (2), with a retention means (20) for the strap lock (4), a guide (17) aligned approximately with the retention means (20) and intended for the free strap end (8) of the strap tongue (3), and a device for generating a relative movement occurring between the retention means (20) and the guide (17) in order to push the free strap end (8) into the orifice (7) of the strap lock (4). The strap tongue possesses a central recess (9) and the device provided on the tool and intended for generating the relative movement has a pushing-forward finger (30) interacting with the recess. The guide (17) for the free strap end is formed by a move-away flap (14) which can assume, in addition to that first position in which the guide (17) extends towards the lock retention means (20), a second position, in which it is further away from the lock retention means (20). Control means (23, 25, 27) are provided for controlling the position of the move-away flap (14) and cause the latter to assume the first position during the introduction of the strap end into the lock and the second position during the clamping of the strap.

14 Claims, 2 Drawing Sheets

Fig. 1
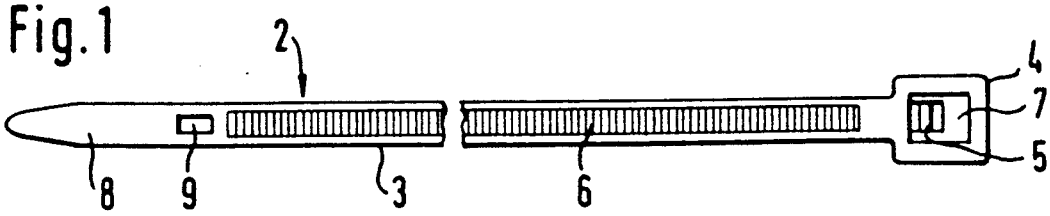
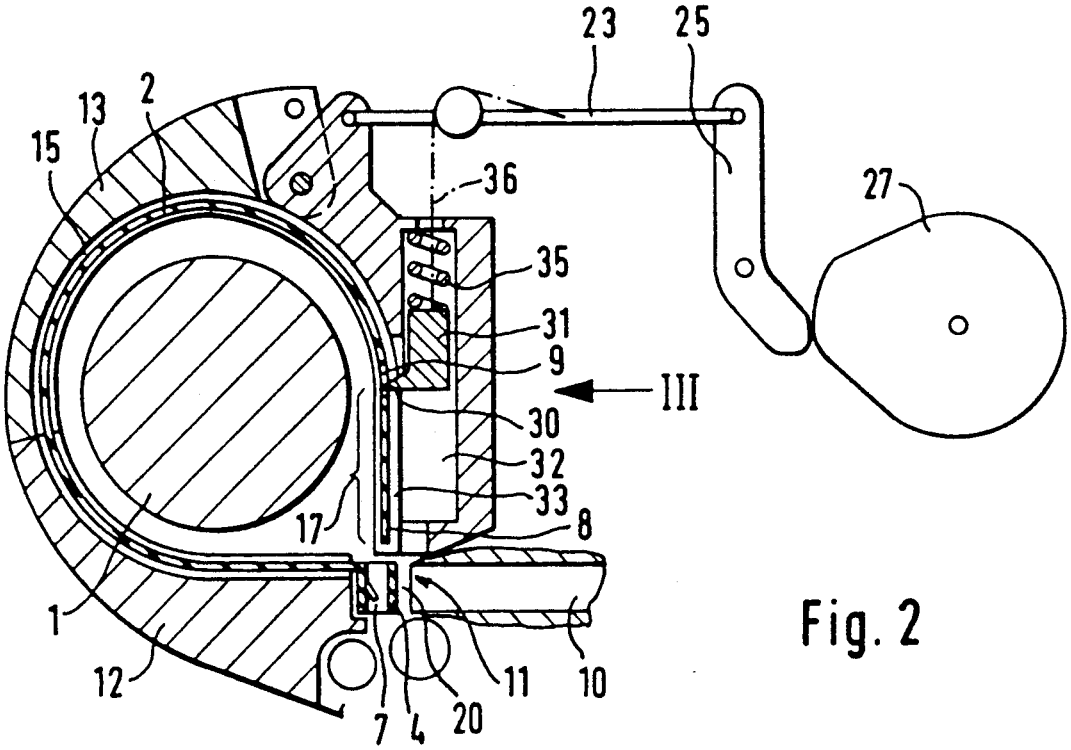
Fig. 2
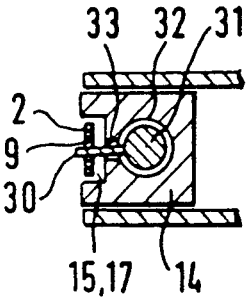
Fig. 3

STRAP AND TOOL FOR LOOPING AND CLAMPING AROUND ELONGATE ARTICLES

The invention relates to a strap for clamping elongate articles and to a tool for looping and clamping the strap around an article. The strap comprises a strap tongue and a strap lock which has an orifice for receiving the strap tongue. The tool possesses a looping guide closable around the article and intended for the ready-to-close strap, with a retention means for the strap lock, a guide aligned approximately with the retention means and intended for the free end of the strap tongue, and a device for generating a relative movement occurring between the retention means and the guide and pushing the free strap end into the orifice.

In a known tool (EP-A-0,264,142), the lock is moved relative to the free strap end, and this can lead to difficulties when the article to be tied virtually fills the free cross-section of the looping guide. The state of the art not previously published also includes a tool in which the free strap end is pushed forwards toward the stationary lock (EP-A-0,390,434). The pushing-forward member is a slide which engages laterally into a notch of the strap and the drive and positioning of which are coupled to part of the looping guide, and this can give rise to complications because the device for introducing the free strap end into the lock orifice transmits to the strap and the looping guide forces which have an undesirable influence on the position of the lock or the free strap end.

The object on which the invention is based is to provide a tool/strap combination of the type mentioned in the introduction, which is free of such problems.

The solution according to the invention avoids these problems, in that the strap tongue has a central recess and the device for generating the relative movement has a pushing-forward finger interacting with the recess.

This allows an interaction of the pushing-forward finger with the strap, in which forces are exerted on the strap which act essentially only in the common plane of the strap center axis and of the pushing-forward finger center axis and do not influence the relative position of the free strap end in relation to the lock orifice. Preferably, the guide for the free strap end is made rectilinear and the pushing-forward finger and guide for the free strap end are so designed that the forces exerted on the free strap end by the pushing-forward finger run solely in the strap direction.

In the known tool mentioned in the introduction, the initial portion and the end portion of the looping guide are arranged transversely relative to one another. The two strap portions adjacent to the lock during clamping therefore also have to extend transversely relative to one another. This is a disadvantage during clamping around articles of approximately round cross-section, for example cable harnesses, because the strap cannot adapt to the contour of the article and therefore possibly remains loose.

This disadvantage is avoided by means of the features of claim 6.

They guarantee, on the one hand, that, after the strap has been looped around the article, the leading end of the strap can assume the correct approximately right-angled initial position for the introduction of the leading strap end into the lock and, on the other hand, that, during the clamping of the strap, the article can approach the lock unimpeded. The strap can therefore also be clamped around, for example, circularly limited articles, without the danger that it will come loose later.

Since the position of the strap portion interacting with the pushing-forward finger is determined by the guide in the move-away flap, it is expedient also to guide the pushing-forward member on the move-away flap. However, this is not absolutely necessary.

According to a further feature of the invention, different drive means are provided for the move-away flap and for the pushing-forward finger, so that the differing nature of the movement of these parts can be taken into account. A particular feature of the pushing-forward movement is that it has to take place quickly and powerfully over a considerable distance. Whilst it may be expedient to derive the movement of the remaining components from cam disks which execute only one joint revolution during each work cycle of the tool, it would present problems if the pushing-forward movement were likewise derived directly from such a cam disk. According to the invention, therefore, for driving the pushing-forward member there is a spring which is retensioned during a period of the work cycle of the tool outside the pushing-forward action. The desired rapid generation of force over a considerable distance can be obtained by relaxing the spring, whilst the tensioning of the spring can be carried out over a longer time, as it were incidentally during other periods of the work cycle.

It is beneficial to the simplicity and effectiveness of the construction if not only the pushing-forward member, but also the spring is arranged on the move-away flap, and if a rope drive is provided for the tensioning movement.

The invention is explained in more detail below with reference to the drawing. In this:

FIG. 1 shows a cable strap

FIG. 2 shows a diagrammatical longitudinal section through the front region of the device in a first operating position, FIG. 3 shows a part section in the region III of FIG. 2, and FIGS. 4 and 5 show longitudinal-sectional representations corresponding to FIG. 2 in other operating stages.

Figure 4:
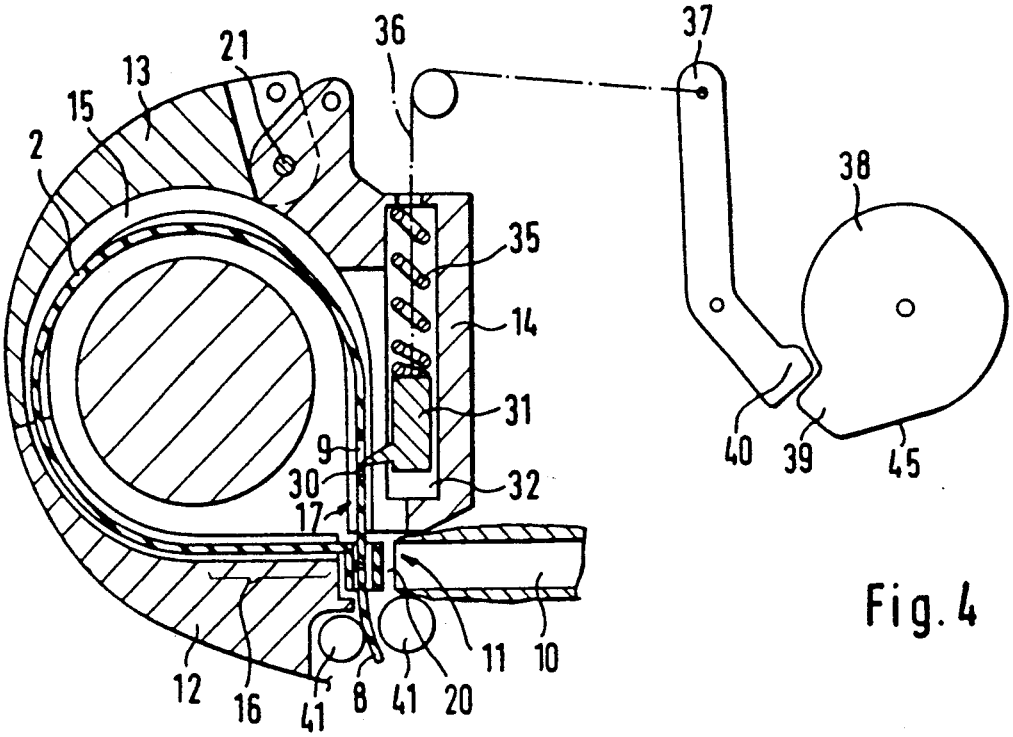

The cable strap 2 to be wrapped around an article 1, for example a cable harness, consists of a strap tongue 3 and of a lock 4 which is connected integrally to the rear end of the strap tongue 3 and which contains a pawl 5 interacting in a self-locking manner with the toothing 6 of the strap when the latter is inserted through the orifice 7 of the lock 4. The so far known strap possesses, near its front end 8, a central cutout 9 which, as explained further below, serves for the engagement of a pushing-forward finger.

The tool for looping the strap 2 around an article 1 and for clamping and cutting off the strap possesses a tool body which is not shown in any more detail in the drawing. It contains a pushing-forward channel 10, in which the strap can be pushed forwards out of a magazine, with the tongue in front, in order to come out of the exit orifice 11 of this channel on the front side of the tool body.

Arranged on the front side of the tool body is the looping guide formed from three flaps 12, 13, 14 containing, in the closed state (FIGS. 2 and 4), a continuous guide groove 15 which, in an initial portion 16, is adjacent to and in line with the channel 10 or the exit orifice 11 and after turning through 270°, in an end portion 17, returns to the vicinity of the exit orifice 11. At the start of the initial portion 16 there is a lock retention means 20 for the lock 4. The end portion 17 of the guide groove forms the guide for the free strap end and feeds this to the lock retention means 20, specifically in such a way that the leading end 8 of the strap 2 is aimed at the orifice 7 of the lock 4.

Figure 5:
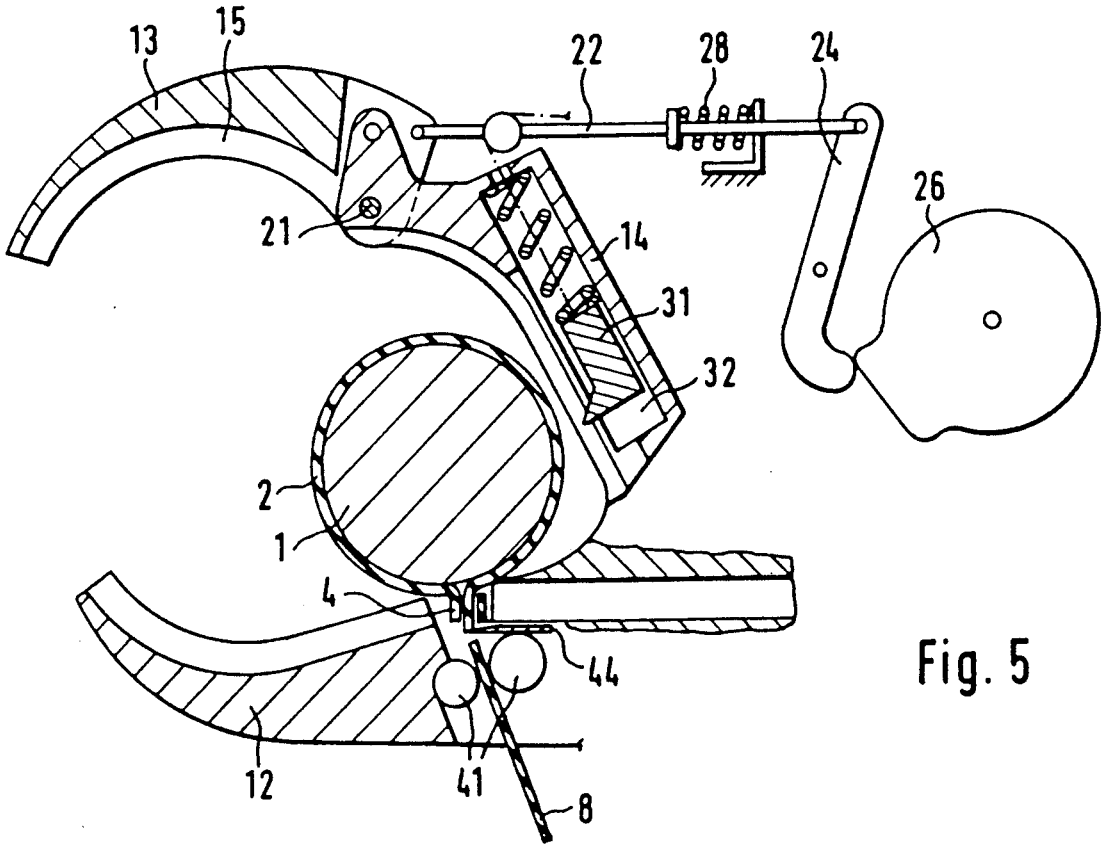

The flaps 12, 13, 14 of the looping guide can assume an opened position, shown in FIG. 5, in order to allow the article 1 to be tied to enter and the tied article to leave. For this purpose, the flaps 13, 14 are connected to drive means which consist respectively of a control 22, 23, of a cam lever 24, 25 and of a cam disk 26, 27 and which can be completed by suitable springs (such as 28 in FIG. 5). For the sake of greater clarity, these drive means (and also those described with reference to FIG. 4) are each shown separately in one of the figures, although they are located next to one another and the associated cam disks 26, 27 are arranged firmly on a common shaft which executes one revolution for each work cycle.

In the closed state, the looping guide 12, 13, 14 has a specific invariable circumferential length which corresponds approximately to the length of the strap 2. As shown in FIG. 2, the leading end 8 of the strap is located in front of the lock 4. It is therefore necessary to have an additional relative movement, by means of which the strap end 8 is introduced into the lock 4. This purpose is served by the pushing-forward finger 30 which, in the position according to FIG. 2, projects into the guide groove 15 at the point at which the orifice 9 is located in the strap. Since the upper flank of the pushing-forward finger is inclined a little in the direction of movement of the strap, the leading portion 8 of the strap, while being introduced into the guide groove 15, slides over and beyond it, until the orifice 9 arrives, into which the pushing-forward finger 30 enters, so that the strap is also laid under its elastic force against the circumferential surface of the guide groove 15 in the vicinity of the pushing-forward finger 30. The elastic force occurs because the strap, in its original state, is straight or has a larger radius of curvature than the strap guide 15 of the looping guide and possesses elastic properties in that it is produced from tough and resilient plastic.

The pushing-forward finger 30 is located on a sliding body 31 which is contained in a sliding bore 32 parallel to the end portion 17 of the guide groove 15 and which can move at least between the end positions shown in FIG. 2 on the one hand and FIG. 5 on the other hand, the pushing-forward finger 30 moving in a slot 33 extending between the sliding bore 32 and the guide groove 15 (FIG. 3).

The sliding body 31 is loaded by a spring 35 which endeavours to shift it out of the initial position according to FIG. 2 into the end position according to FIGS. 4 and 5. In the position according to FIG. 2, it is prevented from doing this by a rope 36 which is anchored on the one hand to the sliding body 31 and on the other hand to a cam lever 37 (FIG. 4), the position of which is determined by a cam disk 38 rotating in the direction of the arrow and arranged firmly on the same shaft as the cam disks 26 and 27. When the cam follower 40 of the cam lever 37 rests on the cam 39, the position of the sliding body 31 shown in FIG. 2 is obtained.

When the cam follower 40 reaches the end of the cam 39 which is of stepped steepness, the sliding body 31 snaps out of the position according to FIG. 2 into that according to FIG. 4 under the effect of the spring 35, the pushing-forward finger 30 driving the end 8 of the strap 2 and introducing it into the orifice 7 of the lock 4 and into the gap between two advance rollers 41 (FIG. 4).

The advance rollers 41 now tension the strap 2 (FIG. 5). At the same time, at least the flap 14 moves to the right in FIG. 5 and thereby moves away, from the article 1 which is urged by means of the strap tension into a position above the lock retention means 20. The flap 14 is therefore designated as a move-away flap. Its entire movement can be positively controlled. It is also possible, however, to fix positively only its first position during the looping operation, whereas during the clamping of the strap it is simply released, so that it can yield to the pressure of the shifting article 1 freely or against spring force.

Furthermore, during the clamping operation the flaps 12, 13 of the looping guide open, in order to free the tied article 1 after the end of the clamping operation.

At the end of this clamping operation, a blade 44 (FIG. 5) cuts off the projecting strap end, and the tied article 1 can be extracted from the tool.

Subsequently, the spring 35 is retensioned for the next work cycle as a result of the engagement of the cam follower 40 with the slowly rising ramp 45 of the cam 39.

The central arrangement of the pushing-forward finger 30 and of the strap orifice 9 and the rectilinear parallel arrangement of the guide groove 17 and the guide 32 of the pushing-forward finger ensure that, despite the rapid movement of the pushing-forward finger, the forces exerted on the free strap end are not such as could lead to a lateral displacement of the latter in relation to the lock orifice 7.

I claim:

1. A strap and a tool for looping and clamping the strap around an elongate article, the strap comprising a strap tongue and a strap lock which has an orifice for receiving the strap tongue, and the tool possessing a looping guide closable around the article and intended for the ready-to-close strap, with a retention means for the strap lock, a guide aligned approximately with the retention means and intended for guiding the free strap end of the strap tongue, and a device for generating a relative movement occurring between the retention means and the guide and pushing the free strap end into the orifice, wherein the strap tongue has a central recess and the device for generating the relative movement has a pushing-forward finger interacting with the recess.

2. The strap and tool as claimed in claim 1, wherein the pushing-forward finger, the guide and the strap are designed for transmitting from the pushing-forward finger to the strap forces which act essentially only in the common plane of the strap center axis and of the pushing-forward finger center axis.

3. The strap and tool as claimed in claim 2, wherein the pushing-forward finger, the guide and the strap are designed for transmitting from the pushing-forward finger to the strap forces which are directed essentially solely in the direction of the free end of the strap tongue.

4. The strap and tool as claimed in claim 1, wherein the free strap end and the guide for the free strap end are made rectilinear, and wherein the strap consists of tough and resilient plastic and the strap guide has a smaller radius of curvature than the non-tensioned strap, so that the free strap end is pressed into the guide.

5. The strap and tool as claimed in claim 1, wherein the guide of the pushing-forward finger is formed parallel to the guide for the free strap end.

6. The strap and tool as claimed in claim 1, wherein the guide for the free strap end is formed by a move-away flap which can assume, in addition to a first position in which the guide extends towards the lock retention means, a second position, in which it is further away from the lock retention means, and wherein control means for controlling the position of the move-away flap are provided in such a way that the latter assumes the first position during the introduction of the strap end into the lock and moves away into the second position during the clamping of the strap.

7. The strap and tool as claimed in claim 6, wherein the guide is slotted, and the pushing-forward finger is movable between the lateral limitations of the groove forming the guide and in the groove direction.

8. The strap and tool as claimed in claim 6, wherein the pushing-forward finger is guided on the move-away flap.

9. The strap and tool as claimed in claim 8, wherein different drive means are provided for the move-away flap and for the pushing-forward finger.

10. The strap and tool as claimed in claim 8, wherein for driving the pushing-forward finger there is a spring which is retensioned during another period of the work cycle of the tool.

11. The strap and tool as claimed in claim 9, wherein cam disks which execute one revolution during an entire work cycle are provided for the movement control of the move-away flap and for the tensioning and, if appropriate, release of the pushing-forward spring and, if appropriate, for the movement control of further components.

12. The strap and tool as claimed in claim 11, wherein the spring is arranged on the move-away flap, and a rope drive is provided for the tensioning movement.

13. The strap and tool as claimed in claim 11, wherein the cam disks provide for release of the pushing-forward spring.

14. The strap and tool as claimed in claim 11, wherein the cam disks provide for the movement control of further components.

* * * * *

UNITED STATES PATENT AND TRADEMARK OFFICE

CERTIFICATE OF CORRECTION

PATENT NO. : 5,050,649

DATED : September 24, 1991

INVENTOR(S) : Viktor Kurmis

It is certified that error appears in the above-identified patent and that said Letters Patent is hereby corrected as shown below:

Col. 5, Claim 5, line 2, delete "the guide of" and after "finger" insert -- has a guide which--.

Col. 6, Claim 10, line 1, change "8" to --9--.

Col. 6, Claim 11, lines 3-6, delete "and, if appropriate, release of the pushing-forward spring and, if appropriate, for the movement control of further components".

Signed and Sealed this

First Day of June, 1993

*Attest:*

Michael K. Kirk

MICHAEL K. KIRK

*Attesting Officer*

*Acting Commissioner of Patents and Trademarks*